United States Patent [19]

Jeremic

[11] Patent Number: 4,520,699

[45] Date of Patent: Jun. 4, 1985

[54] ADJUSTABLE WRENCH

[76] Inventor: Miodrag Jeremic, 509 Carlaw Ave., Toronto, Canada, M4K 3J3

[21] Appl. No.: 455,954

[22] Filed: May 2, 1983

[51] Int. Cl.[3] ..... B25B 13/16

[52] U.S. Cl. ..... 81/166

[58] Field of Search ..... 81/166–168, 81/165

[56] References Cited

U.S. PATENT DOCUMENTS

| | | | |
|---|---|---|---|
| 2,001,789 | 5/1935 | Leaveck | 81/166 |
| 2,376,764 | 5/1945 | Flower | 81/166 |
| 2,912,891 | 11/1959 | Neff | 81/166 X |

FOREIGN PATENT DOCUMENTS

| | | | |
|---|---|---|---|
| 475919 | 4/1915 | France | 81/166 |

*Primary Examiner*—James G. Smith

[57] ABSTRACT

The present invention relates to the head of an adjustable wrench having a threaded member which is secured through a releasable securing member to the wrench key. The wrench head is provided with a first access for gaining access to the releasable securing member to enable removal of the threaded member through a second access in the wrench head for repairs or the like.

1 Claim, 4 Drawing Figures

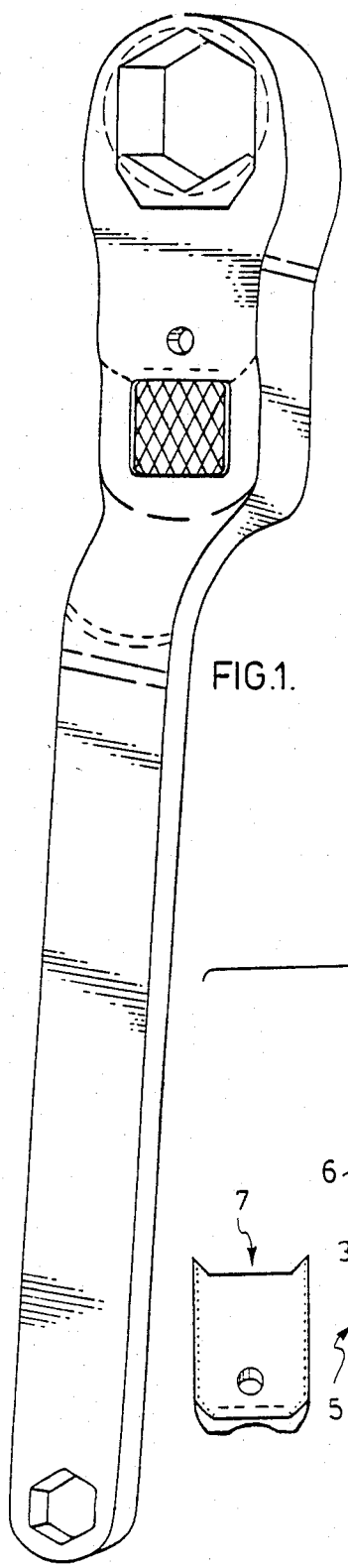
FIG.1.
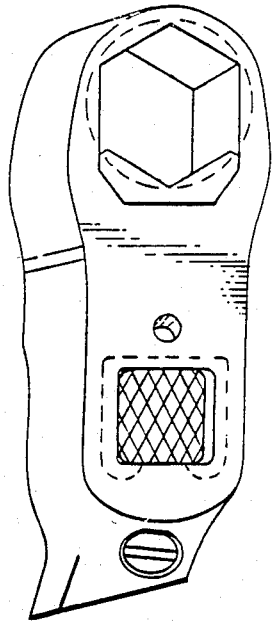
FIG.2.
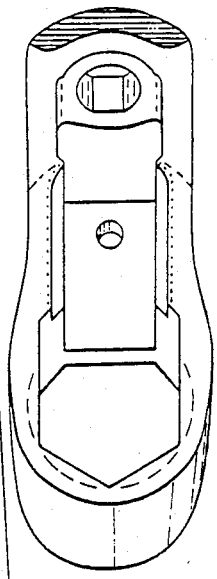
FIG.3.
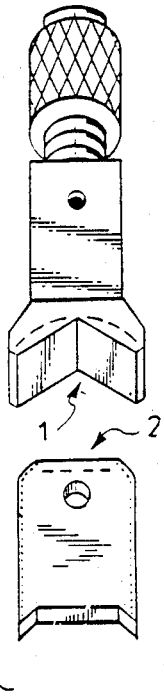
FIG.4.
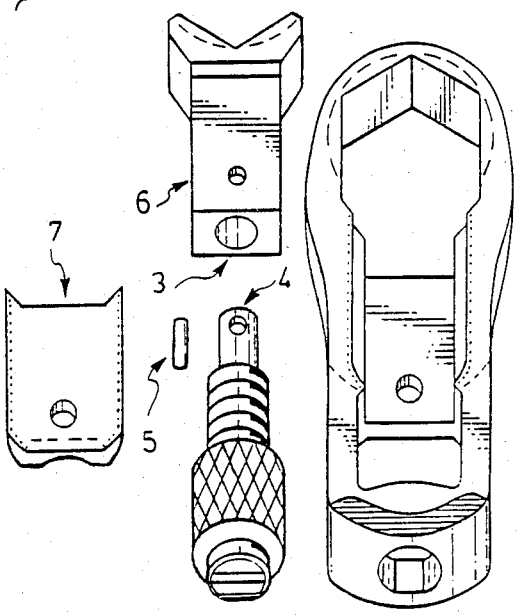

ADJUSTABLE WRENCH

FIELD OF THE INVENTION

The present invention relates to the head of an adjustable wrench having a threaded adjustment system which is removable from the wrench head separately of the key to enable repairs to or replacement of the adjustment system.

BACKGROUND OF THE INVENTION

There are presently available many different types of adjustable wrenches with substantially all of these wrenches having a threaded adjustment system for controlling movement of the wrench key.

The standard arrangement for an adjustable wrench is formed with an integral thread on the movable jaw or key of the wrench. The key thread is exposed at the wrench head and is often subject to damage. In some cases, the key can be removed for repairing the thread or for replacing the entire key and thread combination within the wrench head. In other cases repairs to or replacement of the thread is not possible since both the key and its thread are permanently locked within the wrench so that the wrench is no longer useful even though only the adjustment threads are damaged.

SUMMARY OF THE PRESENT INVENTION

The present invention provides an arrangement adapted to mitigate problems as discussed above with the prior art structures. More particularly, the present invention relates to a wrench head of an adjustable wrench including a cavity, an adjustable key for varying the size of the cavity to accommodate different sizes of nuts and the like, a threaded member substantially enclosed within the wrench head, securing means for releasably securing the threaded member to the key and an adjustment member for threadably engaging the threaded member to adjust position of the key. According to the present invention the wrench head further includes a first access in the wrench head for gaining access to and for removing the securing means to release the threaded member from the key and a second access for removing the threaded member from the wrench head to enable repairs to or replacement of the threaded member.

As a result of the provision of the releasable securing means between the threaded member and the key and the access to that securing means, the threaded member is easily removed although the key itself remains within the wrench head. Therefore, if the threaded member does require replacement, it is used with the same key rather than having to replace the entire key and thread combination.

BRIEF DISCUSSION OF THE DRAWINGS

The above as well as other advantages and features of the present invention will be described in greater detail according to the preferred embodiments of the present invention in which:

FIG. 1 is a front perspective view of an adjustable wrench according to a preferred embodiment of the present invention;

FIG. 2 is a rear perspective view of the wrench head shown in FIG. 1;

FIG. 3 is an exploded perspective view of the wrench head in an inverted position from that shown in FIG. 2;

FIG. 4 is a further exploded perspective view of the wrench head in the upright position of FIG. 2.

DETAILED DESCRIPTION ACCORDING TO THE PREFERRED EMBODIMENTS

FIG. 1 shows the entire wrench comprising both the handle extending towards the bottom of the figure and the wrench head at the upper end of the figure. It will be noted in FIG. 1 that the handle includes a curved neck portion where it joins the wrench head such that the main body of the handle is offset from the head. This feature can be further seen in FIG. 2 with only a small portion of the neck extending downwardly from the wrench head whereby the handle is offset to the front of the wrench.

The components of the wrench head are shown in assembled form in FIG. 2 and exploded out of position in FIGS. 3 and 4. Thse components comprise a movable key 6 having an angled face 1 located within the wrench cavity for completing the hexagonal shape of the cavity.

The key is provided at its opposite end from the key face with a rear opening 3 for receiving the reduced diameter neck portion of a square threaded nut and bolt combination 4. It will be seen that this reduced diameter neck portion includes a hole extending completely through the neck which is adapted to slide into opening 3 at the rear of key 6. A pin 5 is provided for fitting into the key through a pair of aligned openings in the body of the key as can be seen in FIGS. 3 and 4 from opposite sides of the key. These openings in combination with the hole in the neck of the threaded bolt allow the pin to be slid into and out of a securing position for integrating the stem with the key. The size of the openings are such that the pin is frictionally held once in position.

The body of the wrench head includes a cover plate 2 which, prior to assembly, is separate from the wrench head to allow the main body of the key to be fitted within a narrow channel region of the wrench head. The cover plate is then welded to the wrench head to permanently trap the key in its position.

Both the front surface of the wrench and the cover plate, which forms the back surface of the wrench are provided with a further set of aligned openings laterally through the wrench head. The wrench head is also provided with a longitudinal opening at the area adjacent to the curved neck portion of the handle so that this area is easily accessible without interference from the handle. The lateral openings through the wrench head allow access to pin 5 when the key is moved to its most rearward position as shown in FIGS. 1 and 2 so that the rear of the cavity wall acts as a guide where the pin aligns with these lateral openings. The pin can then be pushed out of position to release the threaded bolt from the key whereby the bolt can be removed from the wrench head through the longitudinal opening at the base of the wrench head. This is easily accomplished by simply rotating the longitudinal fixed threaded nut in the appropriate direction to automatically push the bolt out of the wrench while the key remains in position within the wrench head. It should be noted from FIGS. 3 and 4 that the longitudinal opening has a flat side as does the threaded bolt which enhances removal and insertion of the bolt. In addition, the cover plate has a groove on its interior side which, when the arrangement is assembled allows sliding adjustment of the bolt within the channel of the wrench head.

As will be seen from FIGS. 1 and 2, the only portion of the adjustment mechanism exposed on the wrench head is the knurled exterior surface of the adjustment nut so that the threads are protected against exterior damage. However, in the event that the threads need greasing or the like or if the threads become cross-threaded, the threaded bolt is easily reoved from the wrench head by simply sliding the pin out of its locking position through the lateral openings in the wrench head and thereafter removing the threaded bolt through the opening at the base of the wrench head. It will be seen that the bolt is additionally provided with a groove at its exposed outer end for receiving a screw driver as an alternate method of turning the bolt once released from the key to thread the bolt out of the wrench head.

It will be appreciated that other types of securing members such as a small set screw or the like could be used to secure the threaded bolt to the key. Furthermore, when working with an individual set screw only one lateral opening need be provided in the wrench head and the key itself to allow positioning of the set screw. Therefore, although various preferred embodiments of the invention have been described herein and in detail, it will be appreciated by those skilled in the art that variations may be made thereto without departing from the spirit of the invention or the scope of the appended claims.

The embodiments of the invention in which an exclusive property or privilege is claimed are defined as follows:

1. A wrench head of an adjustable wrench, said wrench head comprising a cavity, an adjustable key for varying the size of said cavity to accommodate different sizes of nuts and the like, cover plates on either side of said cavity, a threaded member substantially enclosed within said wrench head, securing means for releasably securing said threaded member to said key, an adjustment member for threadably engaging said threaded member to adjust position of said key, a first access in said wrench head through at least one of said cover plates for gaining access to and for removing said securing means to release said threaded member from said key, and a second access for removing said threaded member from said wrench head to enable repairs to or replacement of said threaded member while said key remains trapped in said wrench head by said cover plates.

* * * * *